United States Patent [19]

Owens

[11] Patent Number: 5,042,555

[45] Date of Patent: Aug. 27, 1991

[54] FLOOR-SUPPORTED MOVABLE WALL PANEL WITH HEIGHT ADJUSTMENT SYSTEM

[75] Inventor: N. Douglas Owens, New Castle, Ind.

[73] Assignee: Modernfold, Inc., New Castle, Ind.

[21] Appl. No.: 591,436

[22] Filed: Oct. 1, 1990

[51] Int. Cl.[5] ..... E05D 15/26

[52] U.S. Cl. ..... 160/199; 160/40; 160/116; 49/127

[58] Field of Search ..... 160/199, 40, 196.1, 160/180, 206, 213, 116; 49/125, 127, 128, 130; 52/64, 71

[56] References Cited

U.S. PATENT DOCUMENTS

| | | | |
|---|---|---|---|
| 1,514,140 | 11/1924 | Dodge | 160/40 |
| 1,612,443 | 12/1926 | Johnson et al. | 160/206 |
| 1,612,498 | 12/1926 | Smith | 160/206 |
| 1,893,147 | 1/1933 | Oberdorfer et al. | 160/40 |
| 2,114,198 | 4/1938 | Winn | 160/199 X |
| 2,827,957 | 3/1958 | Haws | 160/199 |
| 3,380,506 | 4/1968 | Good et al. | 160/199 X |
| 3,672,424 | 6/1972 | Brown | 160/199 X |
| 3,798,839 | 3/1974 | Kaufman | 160/199 X |
| 3,810,330 | 5/1974 | Daggy | 49/127 |
| 4,277,920 | 7/1981 | Dixon | 52/64 |

*Primary Examiner*—David M. Purol
*Attorney, Agent, or Firm*—Baker & Daniels

[57] ABSTRACT

A floor supported movable wall panel system comprises a movable wall panel having opposing sides, an aperture in at least one of the opposing sides, a floor support assembly engagable with a floor, the assembly comprising a floor engaging mechanism, a support mechanism upwardly extending from the floor engaging mechanism and intermediate the opposing sides, the support mechanism supporting the wall panel, the support mechanism including an adjustment mechanism for adjusting the vertical distance between the floor and the wall panel, and the adjustment mechanism being located so as to be accessible through the aperture. A resilient, flexible, retractable seal substantailly covers at least one aperture, so that the adjustment mechanism may be accessed through the aperture by retracting the seal to expose the aperture. A wall panel may be hingedly connected on each side of a wall panel, and the center panel may be supported by an overhead support system, such as a dolly. This permits the center panel to include a thresholdless pass door. In the preferred embodiment, each overhead support system comprises a distally variable, load bearing bias mechanism engaging the overhead panel support mechanism and the wall panel, whereby the overhead panel support mechanism bears an increasing load of the weight of the panel upon an increase in the distance between the overhead track and the wall panel.

29 Claims, 5 Drawing Sheets

FLOOR-SUPPORTED MOVABLE WALL PANEL WITH HEIGHT ADJUSTMENT SYSTEM

FIELD OF THE INVENTION

This invention relates to movable wall panel systems used to divide large rooms into smaller rooms and, in particular, to systems in which the weight of the panels are supported by the floor of the room.

BACKGROUND OF THE INVENTION

Panels for movable wall systems have traditionally been supported by dollies or trolleys mounted in an overhead track. Individual wall panels in these systems can weigh several hundred pounds each. For systems containing many panels or large panels, the rooms must be provided with very strong and expensive structural support systems that can support the weight of the panels, the overhead track, and related hardware. With increased concern over construction costs, alternatives to overhead-supported wall panel systems are important.

One alternative to overhead-supported wall panel systems is a floor-supported system. With such a system, wheels are mounted on the bottom of each wall panel, and the weight of the panel is supported by the floor of the room. Each panel also has a guide or bolt projecting from the top of the panel, which fits into an overhead track, and which prevents the panel from tipping over. Although an overhead track and its associated hardware are still required, they need not be strong because they do not support the weight of the wall panels.

Despite the advantages of floor-supported wall panel systems, the distance between the bottom of a wall panel and the floor for these systems is difficult to adjust. Obviously, in any wall panel system, the wall panels should extend from just above the floor to just below the ceiling. Flexible seals or sweeps are mounted on the upper and lower edges of the panel to provide a completely solid wall without gaps between opposite sides of the panel, while still minimizing friction so the panels may be easily moved. Thus, the height of a wall panel above the floor must be carefully adjusted when it is installed. In addition, over time, floors and ceilings of building are prone to "deflect," or change their vertical position. Roof deflection can be caused by, for example, heavy snow on the roof of a building, while floor deflection can be caused by a heavy load on the floor. Therefore, it is often necessary to readjust the distance of a wall panel from the floor to account for floor or ceiling deflection.

The height of prior art floor supported wall panels is difficult to adjust. The wheels are located below the panel and are connected by an upwardly-extending threaded bolt to the frame of the wall panel. In order to adjust the height for one type of prior art panel, the panel must be lifted out of its floor guide track and swung to one side of the track, taking care to ensure that the panel does not slip out of the upper track and fall to the floor. The lower guide wheels (and the connected threaded bolt) are then manually rotated to screw the bolt into or out of a nut welded to the wall panel frame. The wall panel is then lifted and tilted so the floor guide enters the floor guide track, again taking care to prevent the panel from tipping over. This procedure is particularly cumbersome when adjacent panels are connected by hinges, as all panels must be tilted out just to adjust the height of one panel.

Another type of height adjustment mechanism for floor-supported wall panels does not require the guide wheels to be rotated. Instead, the nut which engages the threaded shaft from the guide wheels may be freely screwed to any desired vertical position on the shaft. The top of the nut abuts the frame of the panel, so as the nut is rotated to move away from the guide wheels, the wall panel will be raised accordingly. The shortcoming of this system is that the adjustment nut is located within the frame of the panel. Therefore, the panel must be constructed with a hole adjacent to the adjustment nut. In order to prevent unsightly exposure of this hole, a kick plate is screwed onto the lower portion of the panel to cover the hole. However, such kickplates are not only cumbersome to remove and replace, but also add to the cost of the panel and detract from its aesthetic appearance.

Another shortcoming of existing floor-supported wall panels is that it is not possible to include a pass door in such a wall panel unless the panel includes a threshold. This is because floor support mechanisms are positioned in the middle of a wall panel, which is the same location where a pass door is positioned. However, thresholds are undesirable in wall panels because persons are prone to trip over the thresholds when going through the pass door.

It is also known to provide a dolly for an exterior aircraft hanger door in which the dolly includes a spring connecting the dolly to the door. Such a system allows the door to compensate for variations in the height of the ground.

OBJECTS OF THE INVENTION

Accordingly, it is an object of the invention to provide a floor-supported wall panel which does not need to be tilted in order to adjust its vertical height.

It is another object of the invention to provide a floor-supported wall panel which does not require a removable cover on the surface of the panel in order to access the height adjustment mechanism.

It is another object of the invention to provide a floor-supported wall panel system which may include three panels hinged together, and in which the middle panel includes a pass door.

It is another object of the invention to provide a combined floor-supported and overhead-supported wall panel system in which adjustment of the floor support system serves to automatically adjust the load borne by the overhead support system.

SUMMARY OF THE INVENTION

A floor supported movable wall panel system comprises a movable wall panel having opposing sides, an aperture in at least one of the opposing sides, a floor support assembly engagable with a floor, the assembly comprising floor engaging means, support means upwardly extending from the floor engaging means and intermediate the opposing sides, the support means supporting the wall panel, the support means including adjustment means for adjusting the vertical distance between the floor and the wall panel, and the adjustment means being located so as to be accessible through the aperture. A resilient, flexible, retractable seal substantially covers at least one aperture, so that the adjustment means may be accessed through the aperture by retracting the seal to expose the aperture. A wall panel may be hingedly connected on each side of a wall panel, and the center panel may be supported by an overhead support system, such as a dolly. This permits the center panel to include a thresholdless pass door. In the preferred embodiment, each overhead support system comprises a distally variable, load bearing bias means engaging the overhead panel support means and the wall panel, whereby the overhead panel support means bears an increasing load of the weight of the panel upon an increase in the distance between the overhead track and the wall panel.

DETAILED DESCRIPTION OF THE PREFERRED EMBODIMENT

Figure 1:
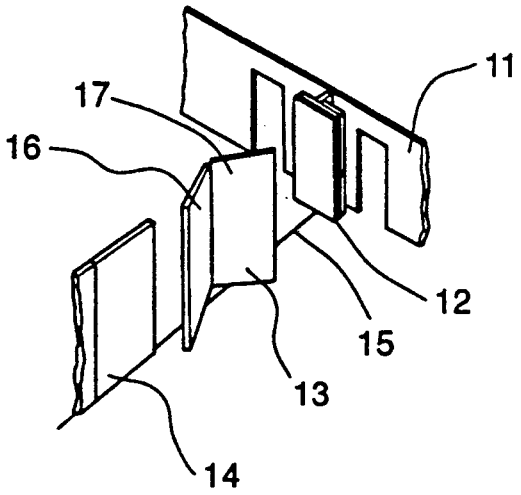
FIG. 1 is a perspective view of several hinged wall panels in both storage and usage positions.

FIG. 1 is a perspective view of several hinged wall panels in both storage and usage positions. Wall 11 defines a boundary of a room. Wall panel set 12 is located in a storage position, while wall panel set 14 is located in a usage position whereby it divides the room into smaller rooms. Wall panel set 13 is shown being moved along floor track between storage and usage positions. Adjacent individual wall panels may be connected by hinges.

Figure 2:
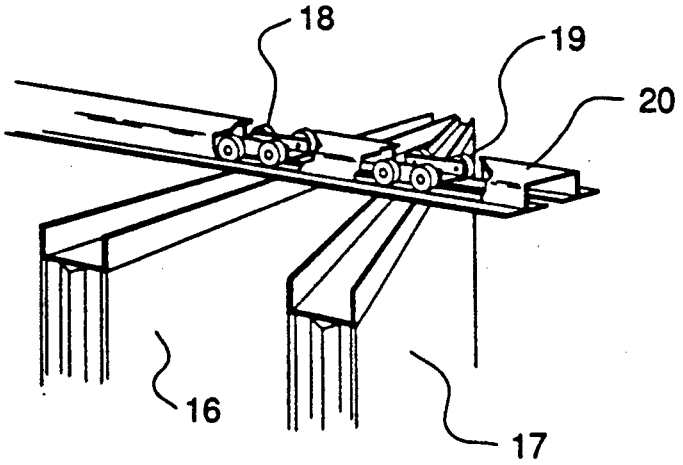
FIG. 2 is a perspective cut-away view showing two panels suspended by dollies from an overhead track.
Figure 3:
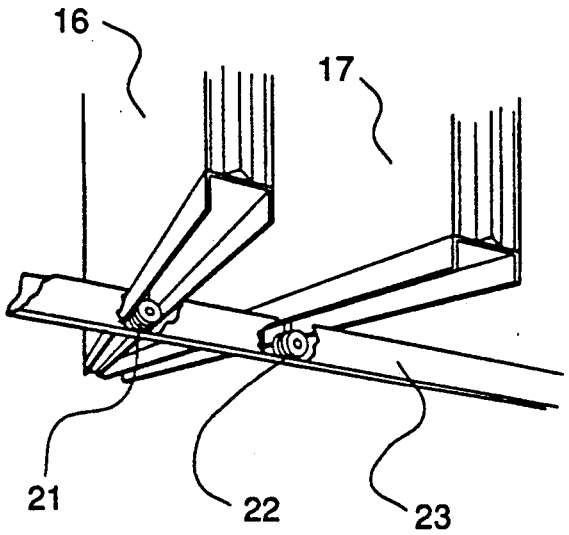
FIG. 3 is a perspective cut-away view showing two panels supported by floor mounted rollers in a track.

FIG. 2 is a perspective cut-away view showing panels 16 and 17 suspended by dollies 18 and 19 from overhead track 20. As shown in FIG. 3, each panel 16 and 17 may also be supported by the floor support system, 21 and 22, which fit into floor track 23. It is generally desirable to position the overhead dollies 16 and 17 and the floor support systems 21 and 22 along each respective wall panel's vertical axis so that each wall panel may rotate about such axis.

Figure 4:
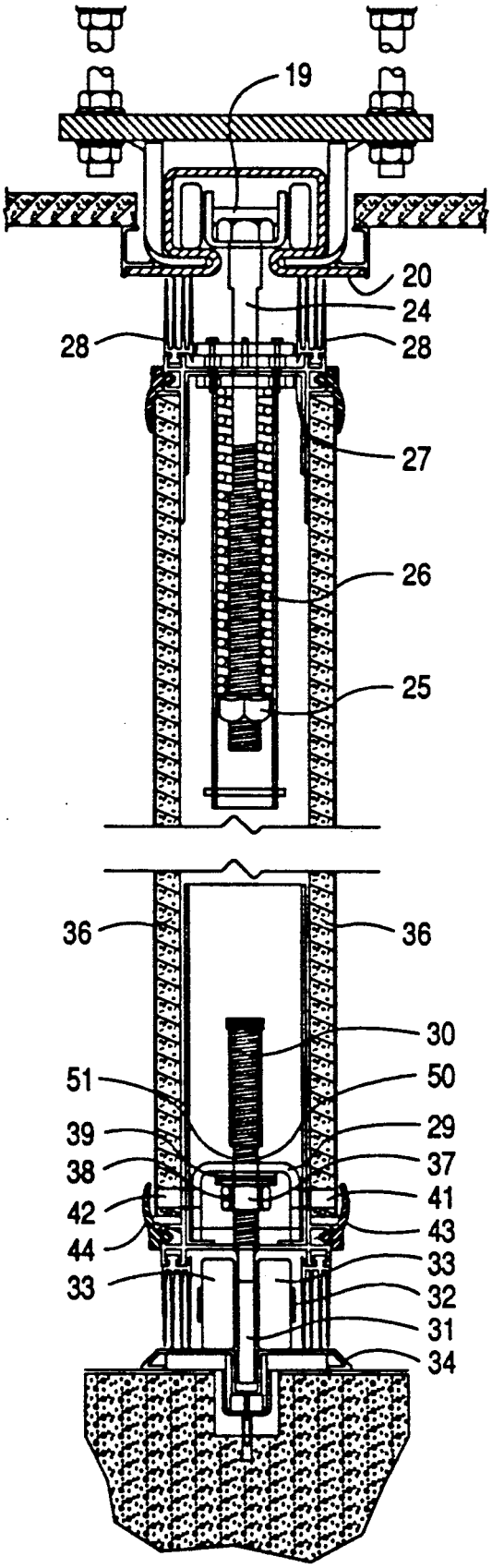
FIG. 4 is a section view of a panel system having an adjustable support means in accordance with the present invention.

FIG. 4 is a section view of a panel system having an adjustable upper and lower support means in accordance with the present invention. The overhead support system for the wall panel is as follows. Dolly 19 fits in overhead track 20, and includes pendent bolt 24, which passes through an aperture in the upper channel of the wall panel. Nut 25, which comprises a stop means, is screwed on bolt 24 and supports spring 26, which engages top channel 27. Spring 26 comprises a distally variable, load bearing bias means that engages the wall panel and bolt 24. Thus, extent of the weight of the wall panel supported by dolly 19 may be adjusted by rotating bolt 26 through nut 25 to adjust the compression of spring 26. Alternatively, the extent of the weight of the wall panel supported by dolly 19 may be adjusted by varying the distance between the wall panel and the floor through adjustment of the floor support means as described below. The gap between the top of the wall panel and overhead track 20 is filled by resilient sweep seals 28.

The lower end of the opposing sides 35 the wall panel are separated by bottom U channel 29. Passing through a central aperture in U channel 29 is bottom threaded support bolt 30, which is welded at its lower end to track guide plate 31. Guide plate 31 holds axle 32, on which floor engaging support wheels 33, which comprise bearings are mounted. Adjusting nut 37 is threadably mounted on support bolt 30. As nut 37 is rotated, U channel 29, and the rest of the wall panel may be raised or lowered as desired. In the preferred embodiment as shown in FIG. 4, as adjusting nut 37 is raised, the distance between the wall panel and floor 34 will increase. Accordingly, this will reduce the compression of spring 26, and reduce the load of the panel borne by overhead dolly 19. Likewise, lowering adjusting nut 37 will lower the panel and compress spring 26, causing spring 26 (and dolly 19) to bear a greater portion of the weight of the wall panel. Washers 39 minimize friction between nut 37 and U channel 29 when nut 37 is rotated.

Figure 5:
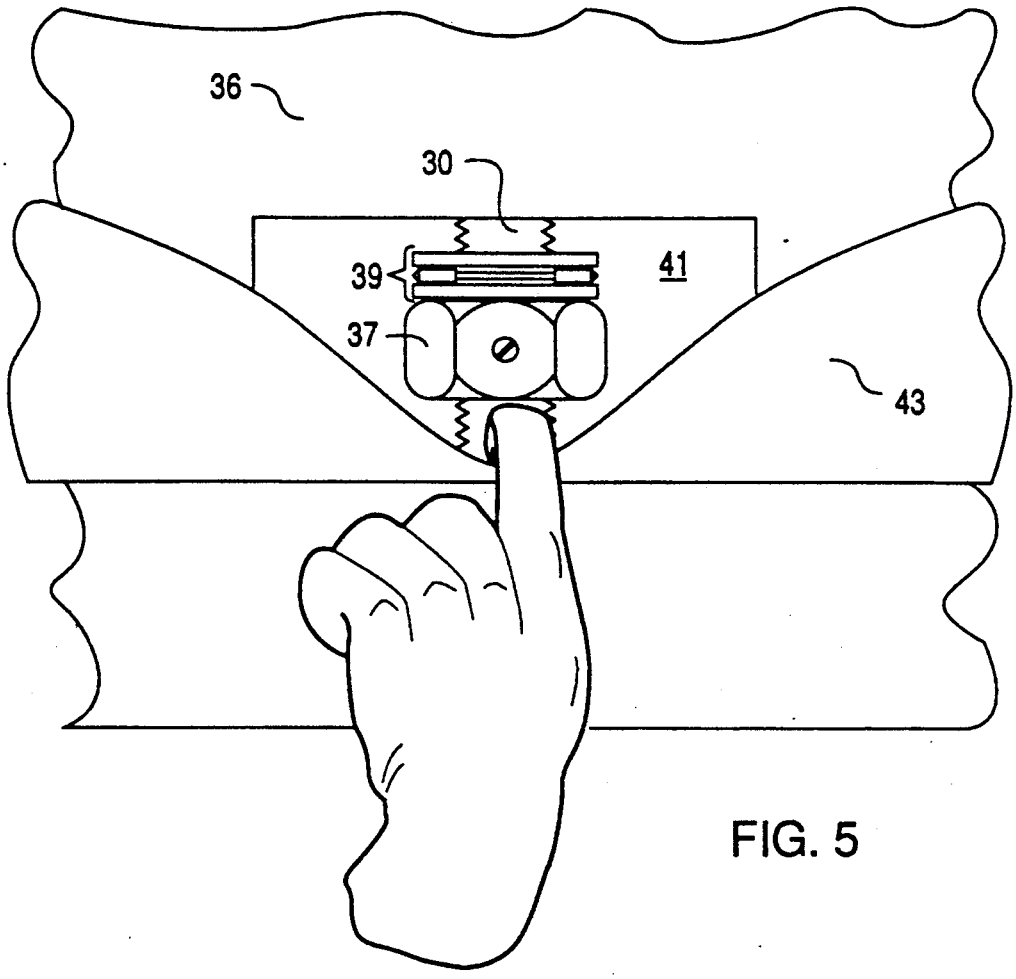
FIG. 5 is a side view showing access to the panel height adjusting system in accordance with the present invention.

An important feature of the invention is that each opposing side 35 and 36 includes an aperture 41 and 42. Apertures 41 and 42 only span a few inches in the middle portion of each opposing side 35 and 36, but are of sufficient size to permit an open end wrench to be passed therethrough to adjust nut 37. However, during normal operation of the wall panel, apertures 41 and 42 are covered by resilient retractable seals 43 and 44, which in the preferred embodiment, traverse the entire width of the wall panel. However, as shown in FIG. 5, each resilient seal 43 may be downwardly retracted to expose aperture 41 and adjusting nut 37 so that nut 37 may be rotated. Adjusting nut 37 also contains set screw 38, which may screwed against either of milled sides 50 or 51 of support bolt 30 to prevent rotation of nut 37 after its final vertical position has been set.

Figure 6:
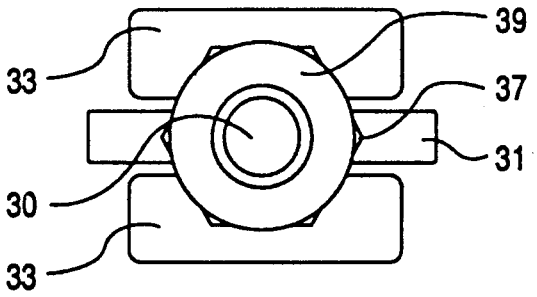
FIG. 6 is a top view of the floor support assembly in accordance with the invention.

FIG. 6 is a top view of the guide wheel assembly in accordance with the invention. Guide plate 31 is positioned intermediate support wheels 33. Support bolt 30 extends upward from guide plate 31. Adjusting nut 37 is threadably mounted on support bolt 30, and has washers 39 positioned above it. A washer (not shown) may also be positioned between each support wheel 33 and guide plate 31.

Figure 7:
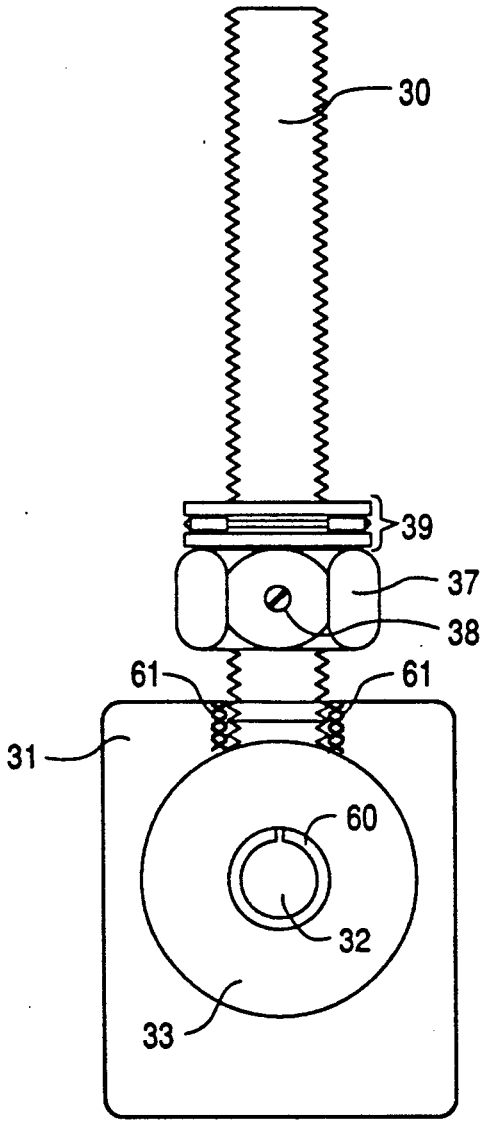
FIG. 7 is a side view of the floor support assembly in accordance with the invention.

FIG. 7 is a side view of the guide wheel assembly in accordance with the invention. Retaining washer 60 holds support wheel 33 to axle 32. Support bolt 30 contains a central notch in its lower portion, into which a top portion of guide plate 31 fits. Guide plate 31 is welded to support bolt 30 at welds 61.

Figure 8:
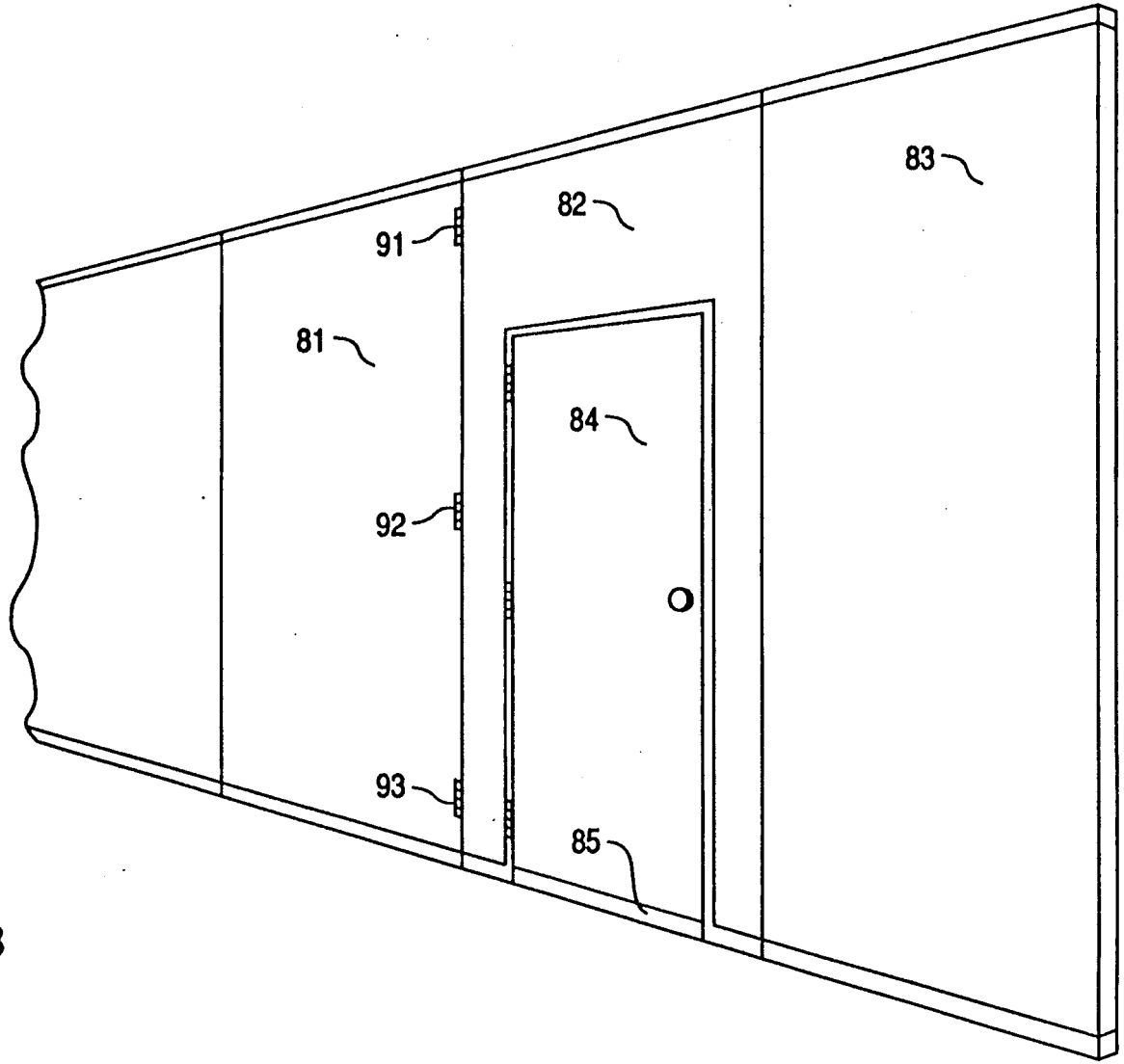
FIG. 8 is a perspective view showing three hingedly connected wall panels with a thresholdless pass door in the center panel.

FIG. 8 shows first 81, second 82 and third 83 hingedly connected wall panels. Panels 81 and 82 are connected along their side edges by hinges 91, 92 and 93, while panels 82 and 83 are connected by hinges (not shown) on the opposite side of the panels. Wall panels 81 and 83 each have a central floor support assembly as shown in FIG. 4, permitting each panel to rotate about the vertical axis of its floor support assembly. Middle wall panel 82 is not supported by a floor support assembly, but by an overhead dolly as shown in FIGS. 2 and 4 and, to some extent, by the hinges connecting it with wall panels 81 and 83. An important feature of the present invention is that middle wall panel 82 includes a thresholdless pass door 84, which is shown in a closed position in which it is substantially flush with panel 82. Pass door 84 may be hingedly opened to permit passage therethrough. Because middle panel 82 is supported by other means, no floor support assembly is required. Therefore, unlike prior devices, the middle panel need not contain a threshold below the pass door to hold a floor support assembly. This significantly reduces the risk of a person tripping when passing through the door. In the preferred embodiment, pass door 84 includes resilient sweep 85 to provide an improved acoustical barrier when pass door 84 is in the closed position.

I claim:

1. A floor supported movable wall panel system comprising: a movable wall panel having opposing sides,
an aperture in at least one of the opposing sides,
a floor support assembly engagable with a floor, said assembly comprising
floor engaging means,
support means upwardly extending from the floor engaging means and intermediate the opposing sides, the support means supporting the wall panel, the support means including adjustment means for adjusting the vertical distance between the floor and the wall panel, the adjustment means being located so as to be accessible through the aperture,
a resilient, flexible, retractable seal substantially covering at least one aperture, such that the adjustment means may be accessed through the aperture by retracting the seal to expose the aperture.

2. The floor supported movable wall panel system of claim 1 wherein the support means comprises a threaded shaft and the adjustment means comprises a threaded nut rotatable on the shaft.

3. The floor supported movable wall panel system of claim 1 in which the seal traverses the width of the wall panel.

4. The floor supported movable wall panel system of claim 1 further comprising track guide means operatively connected to the floor engaging means.

5. The floor supported movable wall panel system of claim 1 further comprising overhead wall panel support means connected to the movable wall panel.

6. The floor supported movable wall panel system of claim 1 wherein the wall panel is rotatable around the vertical axis of the floor support assembly.

7. The floor supported movable wall panel system of claim 1 wherein the seal further comprises a portion affixed to the wall panel and a retractable edge extending from the affixed portion.

8. A floor supported movable wall panel system comprising:
first, second and third wall panels, each panel having first and second side edges, the second edge of the first wall panel being hingedly connected to the first edge of the second wall panel, and the second edge of the second wall panel being hingedly connected to the first edge of the third wall panel,
the first and third wall panels each comprising floor support means, and the second wall panel not having floor support means,
the second wall panel comprising a load-bearing overhead support means and a thresholdless hinged pass door, the hinged pass door being movable between a first closed position in which the pass door is substantially flush with the second wall panel and an open position permitting passage through the second wall panel.

9. The floor supported movable wall panel system of claim 8 wherein the floor support means comprises a threaded shaft and a threaded nut rotatable on the shaft.

10. The floor supported movable wall panel system of claim 8 wherein the first and third wall panels further comprise
overhead support means,
opposing sides,
an aperture in at least one of the opposing sides of the first and third wall panels,
and wherein the floor support means of the first and third wall panels comprise a floor support assembly engagable with a floor, said assembly comprising floor engaging means,
support means upwardly extending from the floor engaging means and intermediate the opposing sides, the support means supporting the wall panel, the support means including adjustment means for adjusting the vertical distance between the floor and the wall panel, the adjustment means being located so as to be accessible through the aperture, and
a resilient, flexible, retractable seal substantially covering at least one aperture, such that the adjustment means may be accessed through the aperture by retracting the seal to expose the aperture.

11. The floor supported movable wall panel system of claim 10 wherein the seals of the first and third wall panels traverse the width of the wall panels.

12. The floor supported movable wall panel system of claim 10 further comprising track guide means operatively connected to each floor engaging means.

13. The floor supported movable wall panel system of claim 10 wherein each wall panel is rotatable around the vertical axis of its floor support assembly.

14. A floor supported movable wall panel system comprising:
a movable wall panel having opposing sides connected by top, bottom, and side channels
an aperture in at least one of the opposing sides,
a floor support assembly engagable with a floor, said assembly comprising
a pair of support wheels rotatable about a common horizontal axis,
an axle connecting said wheels,
a threaded shaft connected to the axle and extending upwardly therefrom,
a threaded support member rotatable on the threaded shaft, such that rotation of the threaded support member varies the distance between the wall panel and support wheels, and
a resilient, flexible, retractable seal substantially covering at least one aperture, such that the adjustment means may be accessed through the aperture by retracting the seal to expose the aperture.

15. The floor supported movable wall panel system of claim 14 in which the seal traverses the width of the wall panel.

16. The floor supported movable wall panel system of claim 14 further comprising track guide means operatively connected to the floor engaging means.

17. The floor supported movable wall panel system of claim 14 further comprising overhead wall panel support means connected to the movable wall panel.

18. The floor supported movable wall panel system of claim 14 wherein the wall panel is rotatable around the vertical axis of the floor support assembly.

19. The floor supported movable wall panel system of claim 14 wherein the seal further comprises a portion affixed to the wall panel and a retractable edge extending from the affixed portion.

20. In a movable wall panel having floor support means continuously engaging a floor, a method for varying the amount of weight of the wall panel borne by the floor support means, comprising the steps of:

providing the floor support means with means to vary the vertical distance between the panel and a floor, providing the wall panel with an overhead support system comprising an overhead track and overhead panel support means connected to the panel, said overhead panel support means comprising a distally variable, load bearing bias means engaging the wall panel, whereby the overhead panel support means bears an increasing load of the weight of the panel upon an increase in the distance between the overhead track and the wall panel, and varying the distance from the floor to the wall panel to by use of the floor support means, such that the amount of weight of the wall panel borne by the overhead panel support means varies as the distance between the wall panel and the overhead track varies.

21. The method of claim 20 wherein the distally variable wall panel load bearing bias means comprises a spring.

22. The method of claim 21, wherein the wall panel further comprises an upper channel having an aperture, the overhead panel support means comprises a dependent bolt, extending through the aperture and having stop means, and the spring is positioned intermediate the upper channel and the stop means.

23. A floor support movable wall panel system comprising:

a movable wall panel having opposing sides, a floor support assembly engagable with a floor, said assembly comprising floor engaging means, support means upwardly extending from the floor engaging means and intermediate the opposing sides, the support means supporting the wall panel, the support means including adjustment means for adjusting the vertical distance between the floor and the wall panel, and an overhead panel support means connected to the panel and engagable with an overhead track comprising a distally variable, load bearing bias means engaging the overhead panel support means and the wall panel, whereby the overhead panel support means bears an increasing load of the weight of the panel upon and increase in the distance between the overhead track and the wall panel.

24. The floor supported movable wall panel system of claim 23 wherein the support means comprises a threaded shaft and the adjustment means comprises a threaded nut rotatable on the shaft.

25. The floor supported movable wall panel system of claim 23 further comprising:

an aperture in at least one of the opposing sides, a resilient, flexible, retractable seal substantially covering at least one aperture, such that the adjustment means may be accessed through the aperture by retracting the seal to expose the aperture, and wherein the adjustment means is located so as to be accessible through the aperture.

26. The floor supported movable wall panel system of claim 25 in which the seal traverses the width of the wall panel.

27. The floor supported movable wall panel system of claim 23 wherein the wall panel is rotatable around the vertical axis of the floor support assembly.

28. The movable wall panel system of claim 23, wherein the distally variable wall panel load bearing bias means comprises a spring.

29. The movable wall panel system of claim 23, wherein the wall panel further comprises an upper channel having an aperture, the overhead panel support means comprises a dependent bolt, extending through the aperture and having stop means, and the spring is positioned intermediate the upper channel and the stop means.

* * * * *